US007117981B2

(12) United States Patent
Logan et al.

(10) Patent No.: US 7,117,981 B2
(45) Date of Patent: Oct. 10, 2006

(54) LOAD BEARING MEMBER FOR USE IN AN ELEVATOR SYSTEM HAVING EXTERNAL MARKINGS FOR INDICATING A CONDITION OF THE ASSEMBLY

(75) Inventors: Douglas E. Logan, Bristol, CT (US); Leroy H. Favrow, Newington, CT (US); Robert J. Haas, Coventry, CT (US); Paul A. Stucky, Vernon, CT (US); Neil R. Baldwin, Manchester, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/025,097

(22) Filed: Dec. 19, 2001

(65) Prior Publication Data

US 2003/0111298 A1 Jun. 19, 2003

(51) Int. Cl.
*B66B 3/00* (2006.01)
*B66B 5/00* (2006.01)

(52) U.S. Cl. ..... 187/391; 187/281; 73/158

(58) Field of Classification Search ..... 187/391, 187/393, 414, 281; 73/158, 862.391, 862.392, 73/862.41, 862.453, 862.473; 324/522, 523, 324/525, 527, 539, 543, 237, 238
See application file for complete search history.

(56) References Cited

U.S. PATENT DOCUMENTS 4,427,095 A * 1/1984 Payne et al. ..... 187/291
5,015,859 A * 5/1991 Uejio ..... 250/227.14
5,834,942 A * 11/1998 De Angelis ..... 187/226
5,890,564 A * 4/1999 Olsen et al. ..... 187/250
5,992,574 A 11/1999 Olsen et al.
6,073,728 A 6/2000 Olsen et al.
6,247,359 B1 * 6/2001 De Angelis ..... 73/158
6,289,742 B1 * 9/2001 De Angelis ..... 73/158
6,684,981 B1 * 2/2004 Stucky et al. ..... 187/393
6,886,666 B1 * 5/2005 Stucky et al. ..... 187/393

FOREIGN PATENT DOCUMENTS

| | | | |
|---|---|---|---|
| EP | 0 103 162 A2 | | 3/1984 |
| EP | 0 849 208 A1 | | 6/1998 |
| JP | 02056397 A | * | 2/1990 |
| JP | 06183662 A | * | 7/1994 |
| JP | 11035246 | | 2/1999 |
| JP | 2001002346 | | 1/2001 |
| JP | 2001063938 | | 3/2001 |
| WO | WO 00/58706 | | 10/2000 |

OTHER PUBLICATIONS

Japanese Abstract 07–117989, May 9, 1995 Kubota.*
PCT International Search Report mailed Jun. 21, 2002.
Wire ropes and new suspension means XP–001092527; Lift–Report 27.Jahrg. (2001) Heft 5 (Sep./Oct. 2001).
PCT International Search Report mailed Apr. 25, 2003 (PCT/US 02/40242).

* cited by examiner

*Primary Examiner*—Jonathan Salata
(74) *Attorney, Agent, or Firm*—Carlson, Caskey & Olds

(57) ABSTRACT

A load bearing assembly in an elevator system includes a plurality of discernable markings on an external surface of the assembly. A monitoring device includes at least one detector that detects locations of the markings along the length of the assembly. Changes in spacing between markings provides an indication of belt loading conditions and provides an ability to determine a condition of the belt relative to whether a replacement of the belt may be necessary. A variety of markings and a variety of detecting arrangements are disclosed.

31 Claims, 3 Drawing Sheets

LOAD BEARING MEMBER FOR USE IN AN ELEVATOR SYSTEM HAVING EXTERNAL MARKINGS FOR INDICATING A CONDITION OF THE ASSEMBLY

BACKGROUND OF THE INVENTION

This invention generally relates to load bearing assemblies, such as ropes or belts in an elevator system. More particularly, this invention relates to a load bearing assembly having discernible markings that provide information regarding a condition of the assembly.

Elevator systems typically include a cab and counterweight that are coupled together using an elongated load bearing member. Typical load bearing members include steel ropes and, more recently, synthetic ropes and multi-element ropes such as polymer coated reinforced belts. The increasing use of elevators in high-rise buildings has given rise to the need for an increasing use of the polymer coated reinforced belts because of their weight-to-strength ratios compared to steel roping arrangements.

Inspecting a load bearing member in an elevator system has been accomplished in several ways. With conventional steel roping, a manual, visual inspection of the rope allows the technician to determine when particular strands of the steel rope are frayed, broken or otherwise worn. This inspection method is limited, however, to the exterior portions of the rope and does not provide any indication of the condition of interior strands of the rope. Additionally, this inspection method is somewhat difficult and time consuming and does not always permit complete inspection of the entire length of the load bearing arrangement.

There are similar limitations on using visual inspection techniques on newer ropes. For example, the polymer coated reinforced belts do not permit visual inspection because of the jacket or coating that is typically applied over the cords. Several advances have been proposed for facilitating inspection of such load bearing arrangements. One example is shown in U.S. Pat. No. 5,834,942 where at least one carbon fiber is included in the load bearing member. An electric current is passed through the fiber. By measuring an electrical voltage across that fiber, a determination is made regarding the condition of the load bearing member. This proposal is limited, however, in that it does not provide any information regarding locations of maximum strain along the length of the load bearing member. Moreover, there is no way of guaranteeing that a loss of conductivity through the carbon fiber is directly correlated to strain or damage to the load bearing member. Another shortcoming of such an arrangement is that there is no qualitative information regarding degradation of the load bearing member over time.

There is a need for improved arrangements and methods for determining the condition of load bearing members in elevator systems. This invention provides a unique solution to that problem.

SUMMARY OF THE INVENTION

In general terms, this invention is a load bearing assembly for use in an elevator system. The inventive arrangement includes a plurality of elongated load bearing members. A jacket at least partially encloses the load bearing members. A plurality of detectable markings are longitudinally spaced on at least one side of the jacket. The markings are spaced apart at some interval along the side of the jacket when the assembly is in a first condition. The spacing between at least two of the markings changes responsive to a change in the condition of the assembly.

Changes in spacings between markings provides an indication of stretch, strain or fatigue conditions. The inventive arrangement permits periodic inspection of the condition of the assembly to determine whether system maintenance or belt replacement may be required. Further, the inventive arrangement permits gathering data regarding a history of performance of the assembly.

The markings may be applied to the jacket of the inventive assembly in a variety of ways. For example, laser marking, etching, stamping or painting may be used. The type of marks and the marking technique chosen will depend, in part, on the selected monitoring or inspection technique and equipment.

In one example, pairs of marks are set at a selected spacing while the spacing between the pairs is not necessarily controlled. By monitoring changes in the spacing between the pairs of marks, which preferably is strictly controlled, an indication of the condition of the assembly in the vicinity of the marks can be discerned.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
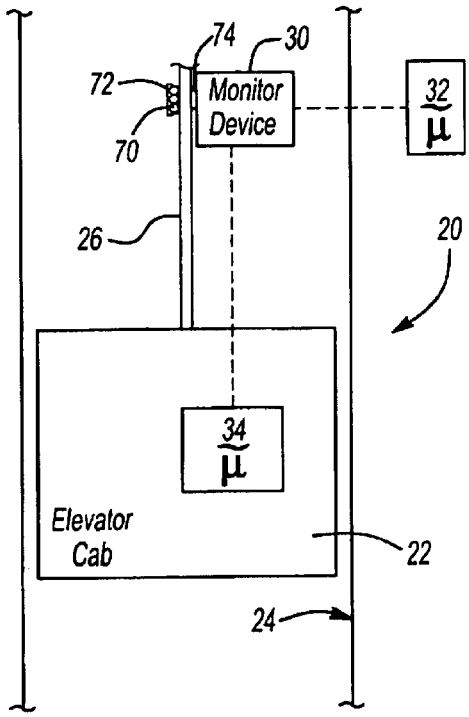
FIG. 1 schematically illustrates an elevator system including a load bearing assembly and a monitoring device designed according to an embodiment of this invention.

FIG. 1 schematically illustrates an elevator system 20. As known in the art, an elevator cab 22 moves through a hoistway 24 between landings and a building, for example. A load bearing assembly 26 supports the cab 22 within the hoistway as the cab moves in a conventional manner.

Figure 1A:
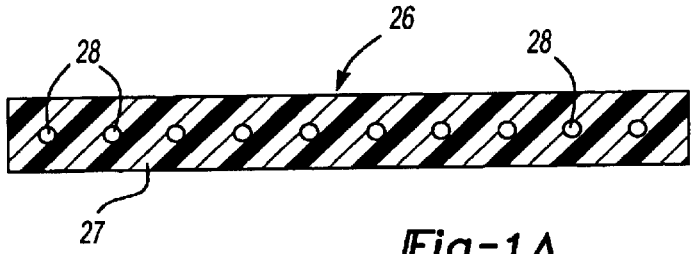
FIG. 1A is a cross sectional illustration of an example load bearing assembly with which the inventive arrangement may be used.

A variety of load bearing assemblies 26 can be used within the scope of this invention. Examples include flat belts. FIG. 1A shows one example having a polymer jacket coating 27 over a plurality of load bearing members 28. Other types of belts or roping may also be used in an embodiment of this invention. The terms "belt" or "rope" should not be construed in their strict sense when used in this description.

A monitoring device 30 is strategically positioned relative to the load bearing assembly 26 to observe a condition of the load bearing assembly 26. The monitoring device 30 may communicate with a remotely located computer module 32 that is usable by an elevator technician, for example. Alternatively (and additionally in the illustrated example) the monitoring device 30 communicates with a controller 34 that is associated with the cab 22. Such controllers are known, although those included in an arrangement preferably are programmed to communicate with the monitoring device as needed for particular situations. In such examples, where the monitoring device 30 is situated within the hoistway 24 over a long period of time, historical data regarding the particular load bearing assembly 26 associated with the cab 22 may be gathered and stored in memory 34 as desired.

Figure 2:
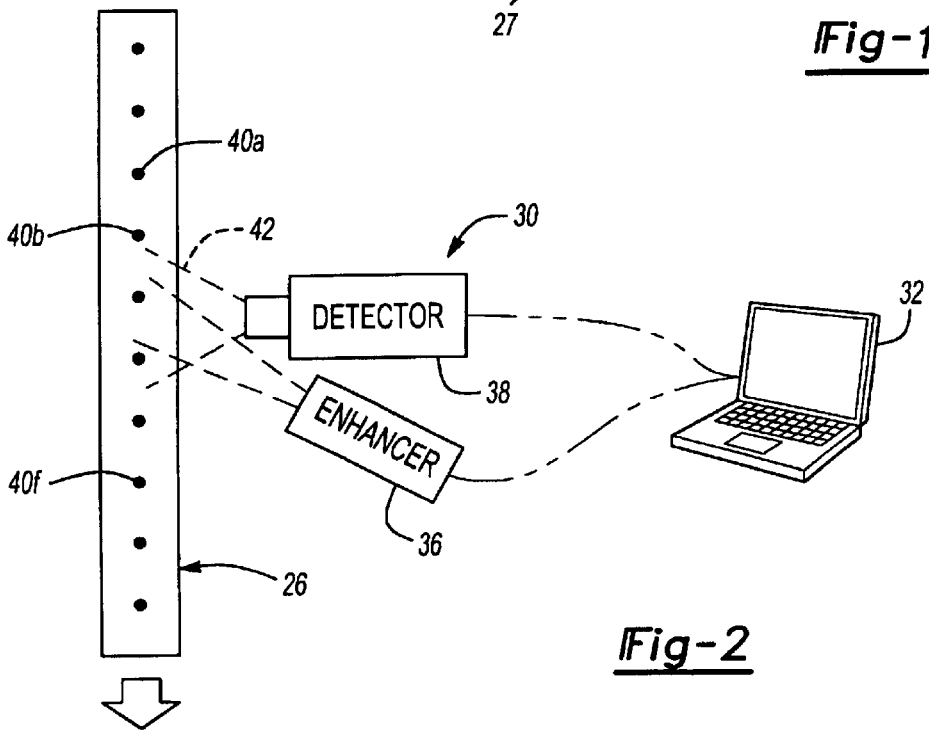
FIG. 2 schematically illustrates selected portions of the embodiment of FIG. 1 in somewhat more detail.

As schematically illustrated in FIG. 2, the monitoring device 30 includes an enhancer 36 and a detector 38. The load bearing assembly 26 includes a plurality of markings 40 along an exterior of the assembly 26. The markings preferably are on at least one side of the jacket of the assembly 26. The detector 38 observes the locations of the markings and is capable of providing information regarding spacing between the markings. The enhancer 36 facilitates better detection through the detector 38. For example, where the markings 40 are optically detectable and the detector 38 is a camera, the enhancer 36 is a light that illuminates the portion of the assembly 26 within the field of vision 42 of the detector 38. The type of detector 38 chosen and whether an enhancer 36 is needed will depend upon the particular configuration of the assembly 26 and the type of markings 40.

The markings 40 on the exterior of the load bearing assembly 26 provide a detectable indication of a condition of the load bearing assembly 26. When the distances or spacing between marks changes, that indicates a change in the condition of the load bearing assembly. As the assembly 26 stretches under load, for example, the spacing will change. Similarly, as the load bearing assembly becomes strained or fatigued, there may be an elongation of some regions of the assembly and a corresponding change in the spacing between markings.

Figure 3:
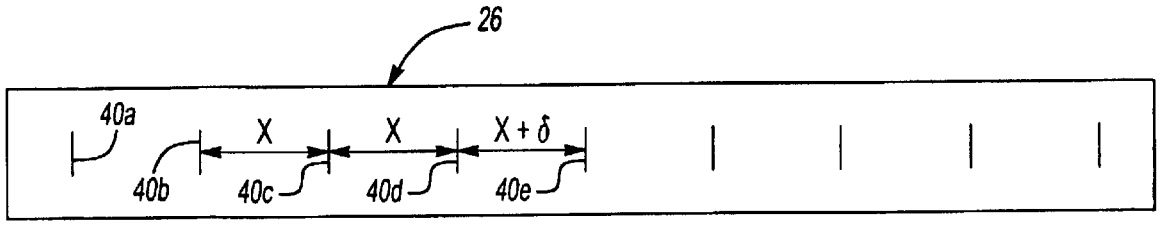
FIG. 3 schematically illustrates a load bearing assembly designed according to an embodiment of this invention.

A variety of types of markings may be used within the scope of this invention. The example of FIG. 2 shows circular markings 40. The example of FIG. 3 shows linear markings 40. Any geometric shape or pattern may be chosen provided that the detector 38 is capable of recognizing the markings and their locations relative to each other on the load bearing assembly 26.

The markings 40 may be applied in a variety of manners. In one example, the markings are painted on an exterior surface of the jacket of the load bearing assembly 26. In another example, a reflective material is applied to the exterior of the jacket. In another example, lasers are used to mark the exterior surface of the assembly 26. The markings may be indented or etched into the surface of the assembly 26. Other alternatives include making marks using an impact device, molding, stamping or heated tooling among others. Depending on the material of the exterior of the load bearing assembly 26, a suitable marking is chosen so that the detectable attributes of the markings remain intact over the expected lifetime of service of the assembly 26.

The markings 40 provide an indication of the condition of the load bearing assembly 26 by providing information regarding stretching or compliance of the load bearing assembly, for example. As can be appreciated from FIG. 3, the monitoring device 30 determines a distance between the markings. In the example of FIG. 3, a distance X is measured between markings 40B and 40C and between 40C and 40D, respectively. A distance X+δ is found between the markings 40D and 40E. By determining the amount of change δ and comparing that to some predetermined standard, a decision can be made whether the section of the assembly 26 corresponding to the section between the markings 40D and 40E has been strained or otherwise damaged sufficiently to warrant replacing the assembly. It may be possible, for example, that the change δ results from loading conditions in the elevator system and not necessarily from a degradation in the quality or fitness of the assembly.

In some examples, the markings 40 preferably are spaced at highly regular intervals longitudinally along the assembly 26. In such examples, the distance between each adjacent marking preferably is identical or within some acceptable tolerance when the assembly 26 is in a first condition, such as after having been produced but before being put in service in an elevator system.

In other examples, the markings 40 are not necessarily placed at a controlled spacing. In such examples, the monitoring device 30 gathers information regarding spacing between adjacent markings when the belt is in a first, known condition and records that data for later comparisons. In such examples, a measurement between two markings is then compared to a subsequent measurement between those same two markings to determine whether there has been a change in the spacing. Because each set of markings may have a different initial spacing, the monitoring device 30 preferably is capable of keeping track of each individual marking and its location on the belt assembly 26 relative to adjacent markings. In such examples, the markings may have unique identifiers incorporated into them to enable the monitoring device 30 to make distinctions between the markings.

In another example, pairs of markings are set at highly controlled spacings so that measurements between selected pairs provide the desired information regarding the condition of the load bearing assembly. In such examples, spacing between the markings of a particular pair preferably are controlled, however, spacing between different pairs need not be regular because only measurements between pairs of markings will be used to make a determination of the condition of the assembly.

Figure 4:
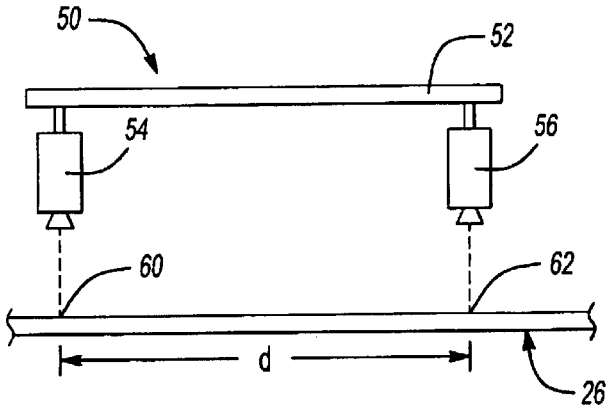
FIG. 4 schematically illustrates an example marking device useful for placing markings on a load bearing assembly in accordance with this invention.

FIG. 4 schematically illustrates a device 50 for making pairs of markings at a controlled spacing d. A structure 52 supports a pair of marking devices 54 and 56. In the illustrated example, the marking devices are lasers that apply markings 60 and 62 to the exterior of the load bearing assembly. Because the marking devices 54 and 56 are at a controlled distance d, the resulting markings on the belt jacket also are at a controlled distance d. The belt 26 may be indexed or moved relative to the devices 54 and 56 so that pairs of markings are placed along a selected length of the belt. Such an arrangement allows for precise spacing between markings for measurement purposes.

Figure 5:
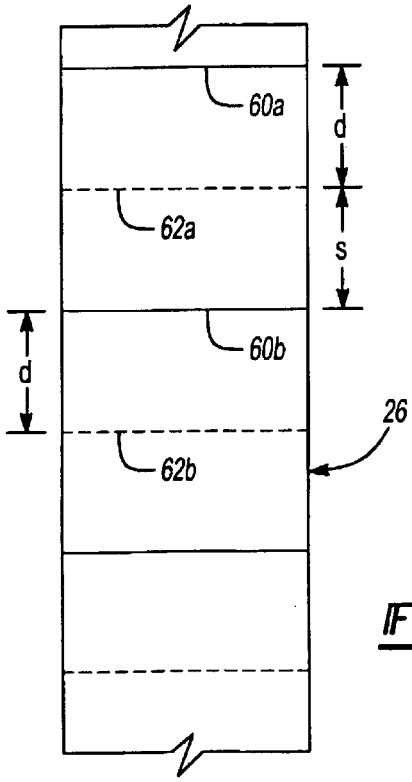
FIG. 5 schematically illustrates another example load bearing assembly designed according to an embodiment of this invention.

Referring to FIG. 5, a first example pair of markings 60A and 62A is spaced apart a distance d. A second pair of markings 60B and 62B are also spaced apart the distance d. A spacing s between the pairs of markings, however, need not be consistent nor need it be the same as the distance d. When the detector 38 gathers information regarding the markings 60 and 62, only the distance between the set markings of each pair will be used to make determinations regarding the condition of the assembly.

As shown in FIG. 5, for example, the pairs of markings preferably include some distinction between the beginning of a pair and the ending of a pair. In the example of FIG. 5, the marks 60A and 60B are continuous lines while the marks 62A and 62B are broken lines. The monitoring device 30 preferably is programmed to recognize that the markings 60A and 60B indicate the beginning of a marking pair and the markings 62A and 62B correspond to the respective ending markings. A strategy for detecting the pairs may include a single detector 38 that has a field of division 42 that will encompass both markings within a pair. Alternatively, two individual detectors 38 may be used having a spatial relationship that allows for each detector to recognize one of the markings from a pair and suitable programming is used to determine the distance between the markings of each pair.

Figure 6:
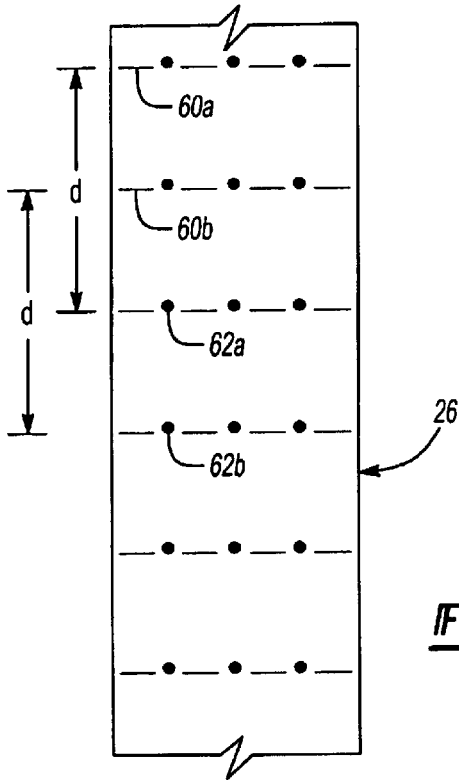
FIG. 6 schematically illustrates a further example of a load bearing assembly designed according to an embodiment of this invention.

In the example of FIG. 5, the pairs of markings do not overlap. In some examples, it may be desirable or necessary to overlap pairs of markings. In such situations, marking distinctions preferably are made so that the monitoring device 30 is capable of recognizing pairs of markings. Such an example is shown in FIG. 6 where markings 60A and 60B are aligned on the exterior of the assembly while markings 62A and 62B are aligned with each other but offset from the markings 60A and 60B. In this example, the markings 60A and 62A constitute a measuring pair. Similarly, the markings 60B and 62B constitute a pair. The monitoring device 30 preferably is programmed to recognize the transverse position of the markings to determine which markings constitute a pair and then to gather information to make a suitable measurement.

A wide variety of marking configurations and distinction strategies may be provided to allow the monitoring device 30 to recognize appropriate pairs of markings and to gather information necessary for making a measurement. Those skilled in the art who have the benefit of this description will be able to realize a suitable arrangement to meet the needs of their particular situation.

There are a variety of marking strategies. The load bearing assembly may be moved past the marking devices in a continuous motion or may be incrementally moved or indexed. Regardless of how the assembly is moved past the marking device or devices, it is desired to maintain a uniform longitudinal tension on the region of the assembly that is being marked.

There are a variety of strategies for controlling spacing between markings. As described, pairs of marking devices may be used at set spacings. Alternatively, a marking device may be triggered to place a new mark on the assembly responsive to detection of a previously made mark at a particular spatial location using an optical sensor, digital or other camera or an indication of linear displacement of the assembly from a rotary encoder or other mechanical sensor, for example.

The markings may be differentiated from the general surface of the exterior of the assembly by color, reflectivity, surface texture or a different physical form compared to the surface profile or contour of the exterior surface of the assembly.

A variety of detectors 38 may be used. In one example, digital array cameras are utilized because they provide a suitable level of quantitative measurements and a variety of hardware and software technology is currently available that may be implemented in a system designed according to this invention. Alternatives include conventional cameras or other optical sensors. Fiber optic sensors, for example, are believed to be a good choice because they are relatively inexpensive. Such sensors may detect changes in proximity, contrast or light reflectance, for example. Given this description, those skilled in the art will be able to choose from among commercially available detecting devices or arrangements to realize the results provided by this invention.

Depending on whether the monitoring device 30 will be one that is temporarily placed within the hoistway by a service technician, for example or is intended to be permanently mounted within the hoistway will dictate the choice of sensor and the type of markings used.

In one example, a laser bar code reader is used to detect the markings on the assembly 26. Laser bar code readers are believed to be a good alternative because they are relatively inexpensive and are robust enough to be permanently located within an elevator system. An example including permanently positioned laser bar code readers may provide data over the lifetime of the assembly in service in the elevator system.

Laser bar code readers can provide information regarding spacing between markings. Additionally, the markings can contain coding or information to identify the markings, respectively.

In one example, the belt jacket is black and the markings comprise white lines on the jacket. Commercially available paints can be used to make the marks. The contrast of the white and black allows the bar code reader to gather the necessary information.

When only one sensing device is used, the movement speed of the load bearing assembly, relative to the sensing device, preferably is carefully controlled and monitored. This can be accomplished through conventional techniques, such as knowing the speed of elevator cab movement, for example.

The monitoring device 30 preferably is kept at a constant distance from the surface of the load bearing assembly that contains the markings. One way of accomplishing this is to use a support device 70 (see FIG. 1) having a plurality of spring-biased rollers or other mechanical guides that are received against the load bearing assembly. A support structure 74 preferably keeps the monitoring device 30 within a chosen range of the load bearing assembly to insure accurate readings. In one example, the rollers or mechanical guides also prevent transverse movement of the load bearing assembly 26 as it moves longitudinally relative to the monitoring device 30.

One example arrangement includes detectors with telecentric lenses to compensate for any changes in relative position between the belt and the detectors.

One preferred arrangement includes two sensing devices that are digital array cameras. The cameras preferably are mounted in a rigid housing built so that the separation between the cameras corresponds to the spacing of pairs of marks (where pairs of marks are used as described above). Where two detectors 38 are included in the monitoring device 30, both detectors are triggered to acquire an image at the same time, which coincides with passing of the respective marks through the field of vision of each camera. In one example, the detectors are triggered to acquire an image at a time that corresponds to when the markings are expected to be within the field of vision of the camera.

In another example, the cameras are always acquiring an image but are triggered to save images at times corresponding to positions of the markings within the field of view. Triggering image acquisition (or saving of an image) can be based upon detecting a mark within a certain portion of the detector's field of view, detecting a mark by an auxiliary camera, detecting a mark by an optical sensor or measuring the linear displacement of the load bearing assembly using a rotary encoder or other sensor, for example.

An enhancer 36 may be used depending on the needs of a particular situation. Where digital array cameras are used as the detectors 38, the enhancer 36 preferably is a strobe light. Strobe lighting is known to achieve optimal blurring of the signals generated by the detectors corresponding to detecting the markings. For example, in some situations the accuracy with which interpolation algorithms can calculate the position of the markings may be enhanced when strobe lighting is used. The duration of the light pulse of the strobe preferably is timed to achieve a desired result. Given this description and the knowledge of those in the art of image acquisition, appropriate strobe or other lighting control can be realized.

The manner of measuring spacings between markings can be accomplished in one of several ways.

In some circumstances it is preferred to take multiple measurements of each mark-to-mark spacing. The measurement data for each spacing then can be statistically treated by the computer module 32 (or the controller 34) to reduce the affects of scatter on the measurement, differentiate marks from cracks or defects in the jacket surface, differentiate engineered marks from accidental scratches or other marks on the surface, eliminate the affects of dust or dirt present on the jacket surface, determine the mark-to-mark spacing accurately despite possible partial destruction of the mark in some positions due to wear or other processes, and detect distortion of the mark that is indicative of unusual tension member strain.

One example includes having an initial measurement when the load bearing assembly 26 is manufactured and using that as a baseline measurement. Such an initial measurement provides an indication of how the markings were initially placed on the load bearing assembly. Such a baseline measure, however, is limited in value when one considers that some stretching of the load bearing assembly may occur simply by placing it into an operative position within the elevator system because of the inherent weight of the cab and the tension on the load bearing assembly.

Another example includes taking a baseline measurement when the elevator system has a known load condition. This baseline measurement can be used against later measurements with the same load conditions. Alternatively, later measurements under different load conditions may be used and some correlating factor based upon the differences in the load conditions is used to make an appropriate determination regarding changes in spacing between the markings.

It is also within the scope of this invention to accommodate changes in the load on the load bearing assembly as it moves past the monitoring device 30. For example, when the elevator cab is at the bottom of a hoistway, the load on a section of the belt near the top of the hoistway is higher compared to when the elevator cab is near the top of the hoistway. This is because the load bearing assembly itself has weight that may contribute to the load on the assembly at a particular location. Accordingly, it is within the scope of this invention to accommodate for changes in spacing between markings along the length of the belt depending on changes in the load condition. It is most preferred to do measurements under controlled load conditions, such as when the cab is empty. It is most preferred to do measurements when the elevator cab is not in service so that passengers do not enter or exit the cab midway through the measuring process along the length of the belt.

One way of accommodating for changes in load on the system is to determine a torque generated by the motor responsible for moving the cab through the hoistway. Torque monitoring techniques are known. Because the torque varies with loading, measuring the torque provides an ability to correlate the weight or load on the system and variations in torque will allow for compensating for variations in load. Therefore, changes in spacing between markings that are attributable to changes in load conditions can be compensated for and appropriately handled while making determinations regarding the condition of the load bearing assembly.

The markings preferably are spaced such that minor changes in distance between marks is discernable. It is desirable to be able to detect 0.1% or less change in distance as such small incremental changes are believed to be an indicator of a change in the condition of the belt.

Figure 7:
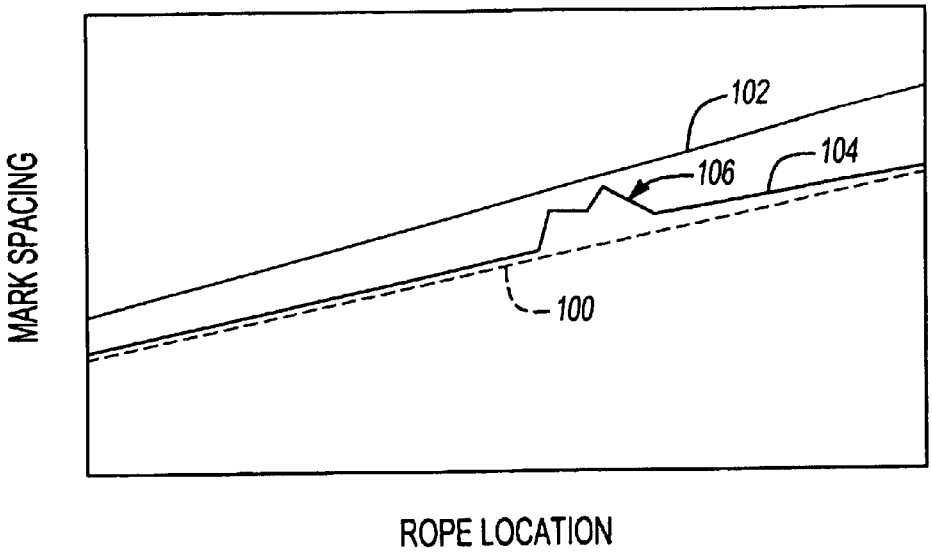
FIG. 7 graphically illustrates an example set of data gathered utilizing the inventive arrangement.

FIG. 7 graphically illustrates one way of analyzing data gathered using the inventive arrangement. An expected spacing of the marks as shown on the plot 100. A first example actual spacing is shown at 102, which represents a uniform degradation of the compliance of the load bearing assembly over time.

Another plot 104 shows a local degradation at 106, which may correspond, for example, to a strained portion of the load bearing assembly resulting from bending fatigue. Depending on the characteristics of a particular load bearing assembly, the differences between the expected spacing 100 and the plots 104 and 102, respectively, will provide an indication of the condition of the assembly and whether replacement is necessary. Known techniques such as bending fatigue testing can be used to develop correlating data so that a decision can be made based upon actual results from a field measurement.

The example of FIG. 7 is useful where the expected spacing 100 is developed from measuring the load bearing assembly shortly after initial installation so that the condition of the assembly is known, under known load conditions. The measurements taken resulting in the plots 102 and 104 preferably are taken later at the same load conditions to provide an accurate comparison from which a condition determination may be made.

Figure 8:
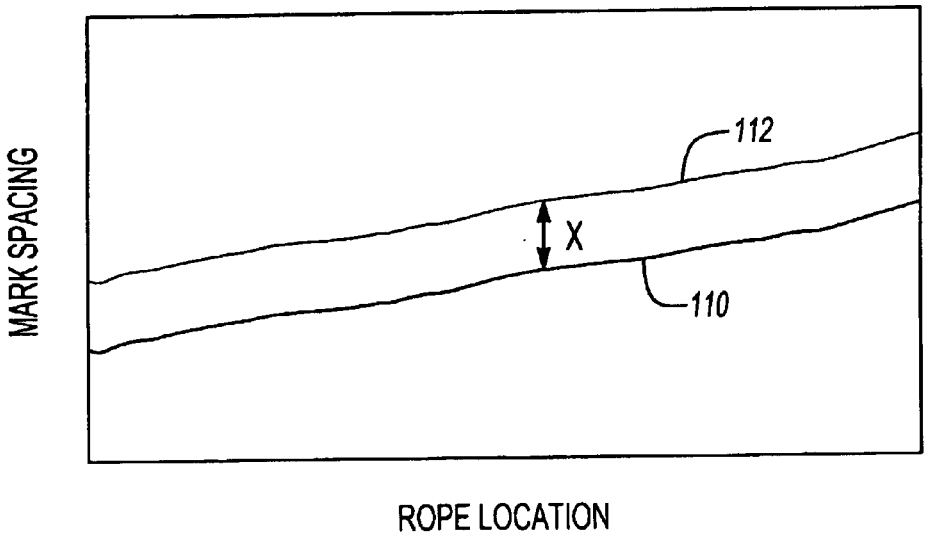
FIG. 8 graphically illustrates another example set of data gathered utilizing the inventive arrangement.

Another example measurement plot is shown in FIG. 8. The distance between spacings at a first load is shown at 110. The distance between spacings at a second load is shown at 112. In this example, if the change between the plots 110 and 112 remains constant along the length of the load bearing assembly, the difference in spacing distances would be attributable simply to the change in load. If there are differing variations along the length of the load bearing assembly, then particular locations along the belt length may be strained or otherwise fatigued.

As can be observed from FIGS. 7 and 8, the spacing between markings increases along the length of the assembly even in the expected spacing plot 100. This is applicable in situations that include a load bearing assembly that undergoes some different amount of stretching depending upon the location of the cab within the hoistway as discussed above.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A load bearing assembly for use in an elevator system, comprising:

a plurality of elongated load bearing members;

a jacket at least partially enclosing the load bearing members; and a plurality of detectable markings longitudinally spaced on at least one side of the jacket, the markings being at a first spacing along the side of the jacket when the assembly is in a first condition, the spacing between at least two of the markings changing responsive to a change in the condition of the assembly.

2. The assembly of claim 1, wherein the markings are optically detectable.

3. The assembly of claim 1, wherein the markings comprise indentations on the side of the jacket.

4. The assembly of claim 1, wherein the markings are spaced with a controlled spacing between sets of adjacent markings.

5. The assembly of claim 1, wherein the markings include a first plurality of first markings and a second plurality of second markings, the first markings being spaced relative to each other and the second markings being spaced relative to each other.

6. The assembly of claim 5, wherein the first markings have a first configuration and the second markings have a second configuration that is different from the first configuration.

7. The assembly of claim 5, wherein the first markings are spaced from each other longitudinally along the jacket and the second markings are spaced from each other longitudinally along the jacket and laterally offset from the first markings.

8. The assembly of claim 1, wherein the jacket comprises a first color and the markings are painted on the jacked and comprise a second color.

9. A method of making a load bearing assembly for use in an elevator system, comprising:

arranging a plurality of load bearing members in a selected alignment;

placing the load bearing members at least partially within a jacket; and placing a plurality of markings longitudinally spaced on at least one side of the jacket such that the markings are spaced at a first spacing when the assembly is in a first condition and the spacing between at least two of the markings changes responsive to a change in the condition of the assembly.

10. The method of claim 9, including using a laser to apply the markings to the jacket.

11. The method of claim 9, including forming the jacket from a first material having a first property and making the markings by applying a second material to the jacket that has a second property that is distinct from the first material property.

12. The method of claim 9, including painting the markings on the jacket.

13. The method of claim 9, including placing a first plurality of markings having a first spatial relationship with each other and placing a second plurality of markings on the jacket having a second spatial relationship with each other.

14. The method of claim 9, including controlling the spacing between adjacent ones of the markings.

15. The method of claim 10, including using two lasers to apply pairs of the markings, the lasers being at a controlled spacing.

16. A method of determining a condition of a load bearing assembly in an elevator system having a plurality of load bearing members within a jacket that includes detectable markings on at least one side of the jacket, comprising the steps of:

determining a current spacing between at least two of the markings; and determining a current condition of the assembly using the current spacing of the markings.

17. The method of claim 16, including determining a baseline spacing under a controlled assembly load condition and using the baseline spacing and the current spacing to determine the current condition.

18. The method of claim 16, including determining a torque of a motor associated with the elevator system that provides a motive force to move the load bearing assembly and using the motor torque and the current spacing to determine the current condition.

19. The method of claim 16, including determining a change in spacing between selected ones of the markings along the length of the assembly, determining a changing in a load on the assembly and determining whether the determined change in spacing corresponds to the determined changing load.

20. A device for inspecting a load bearing assembly in an elevator system, comprising:

a detector that gathers information regarding spacing between external markings on the load bearing assembly; and a controller that utilizes the spacing information gathered by the detector and makes a detennination regarding a condition of the load bearing assembly.

21. A device for inspecting a load bearing assembly in an elevator system, comprising:

a detector that gathers information regarding spacing between at least two of markings on the load bearing assembly; and a controller that uses the spacing information to make a determination regarding a condition of the load bearing assembly and accounts for a change in a load on the assembly and determines whether a change in spacing between selecting ones of the markings corresponds to the change in the load.

22. The device of claim 20, wherein the controller determines an amount of degradation of the load bearing assembly.

23. The device of claim 20, wherein the controller determines an amount of stretch of the load bearing assembly.

24. A device forinspecting an elevator system load bearing assembly that has a plurality of tensile members encased within a jacket, comprising:

a detector that gathers information regarding spacing between external markings on the jacket of the load bearing assembly; and a controller that utilizes the spacing information gathered by the detector and makes a determination regarding a condition of the load bearing assembly.

25. The device of claim 24, wherein the controller determines an amount of stretch of the load bearing assembly.

26. The device of claim 24, wherein the controller determines a degradation of the load bearing assembly.

27. The device of claim 24, wherein the controller accounts for a change in a load on the assembly and determines whether a change in spacing between selected ones of the markings corresponds to the change in the load.

28. The device of claim 24, wherein the controller uses spacing information regarding spacing between at least two of the markings to make the determination regarding the condition of the load bearing assembly.

29. A method of making a load bearing assembly for an elevator system, comprising:

forming at least one load bearing member; and subsequent to the forming establishing a plurality of markings on an exterior of the load bearing member such that a spacing between the markings provides information regarding a load bearing condition of the load bearing member.

30. The method of claim 29, comprising placing a load bearing member at least partially within a jacket; and establishing the markings on an exterior of the jacket.

31. The method of claim 29, comprising at least one of:

using a laser to apply the markings to the exterior;

painting the markings on the exterior;

placing a first plurality of markings having a first spatial relationship with each other and placing a second plurality of markings having a second spatial relationship with each other;

using a reflective material to establish the markings;

indenting an exterior surface of the load bearing member to establish the markings;

etching the markings into the exterior of the load bearing member; or applying a tool to the exterior to establish the markings.

* * * * *

UNITED STATES PATENT AND TRADEMARK OFFICE

CERTIFICATE OF CORRECTION

PATENT NO. : 7,117,981 B2
APPLICATION NO. : 10/025097
DATED : October 10, 2006
INVENTOR(S) : Logan et al.

It is certified that error appears in the above-identified patent and that said Letters Patent is hereby corrected as shown below:

Claim 8, Column 9, line 7: “jacked” should be --jacket--

Claim 20, Column 9, line 66: “detennination” should be --determination--

Claim 20, Column 9, line 67: Before “condition” insert --load bearing--

Claim 20, Column 9, line 67: After “assembly” insert --and accounts for a change in a load on the assembly and determines whether a change in spacing between selected ones of the markings corresponds to the change in the load--

Claim 21, Column 10, line 4: Delete “of”

Claim 21, Column 10, line 7: Before “condition” insert --load bearing--

Claim 21, Column 10, line 10: “selecting” should be --selected--

Claim 24, Column 10, line 17: “forinspecting” should be --for inspecting--

Signed and Sealed this

Twenty-seventh Day of March, 2007

JON W. DUDAS
*Director of the United States Patent and Trademark Office*